US007991308B2

(12) United States Patent
Oh

(10) Patent No.: US 7,991,308 B2
(45) Date of Patent: Aug. 2, 2011

(54) WASTE TONER AMOUNT DETECTING APPARATUS AND METHOD, AND IMAGE FORMING APPARATUS EMPLOYING THE SAME

(75) Inventor: Han-sang Oh, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 11 days.

(21) Appl. No.: 12/557,632

(22) Filed: Sep. 11, 2009

(65) Prior Publication Data

US 2010/0104299 A1 Apr. 29, 2010

(30) Foreign Application Priority Data

Oct. 27, 2008 (KR) ..... 10-2008-0105535

(51) Int. Cl.
*G03G 21/12* (2006.01)

(52) U.S. Cl. ..... 399/35

(58) Field of Classification Search ..... 399/9, 24, 399/25, 34, 35, 107, 110, 111, 119, 120, 399/343, 358, 359
See application file for complete search history.

(56) References Cited

U.S. PATENT DOCUMENTS

| | | | | |
|---|---|---|---|---|
| 4,982,230 | A * | 1/1991 | Ogura et al. | 399/35 |
| 6,731,885 | B2 * | 5/2004 | Anthony et al. | 399/35 |
| 7,454,148 | B2 * | 11/2008 | Kameda | 399/35 |
| 7,526,217 | B2 * | 4/2009 | Takiguchi et al. | 399/35 |

FOREIGN PATENT DOCUMENTS

| | | |
|---|---|---|
| JP | 2000-066556 | 3/2000 |
| JP | 2005-049528 | 2/2005 |

* cited by examiner

*Primary Examiner* — Hoan Tran
(74) *Attorney, Agent, or Firm* — Staas & Halsey LLP

(57) ABSTRACT

Disclosed are a waste toner amount detecting apparatus and method which can detect whether a waste toner bottle is full of a waste toner using a change in a current of a motor which drives an auger, and an image forming apparatus employing the same. The waste toner amount detecting apparatus is in an image forming apparatus which includes a motor current detector to detect a drive current of a motor which rotates an auger for leveling the waste toner contained in the waste toner bottle; and a controller which includes a determining unit to determine whether the waste toner bottle is full of the waste toner, using a difference between a first current value corresponding to a minimum drive current of the motor and a second current value corresponding to a current drive current of the motor.

20 Claims, 7 Drawing Sheets

WASTE TONER AMOUNT DETECTING APPARATUS AND METHOD, AND IMAGE FORMING APPARATUS EMPLOYING THE SAME

CROSS-REFERENCE TO RELATED APPLICATION

This application claims the benefit of Korean Patent Application No. 2008-105535, filed Oct. 27, 2009 in the Korean Intellectual Property Office, the disclosure of which is incorporated herein by reference.

BACKGROUND OF THE INVENTION

1. Field of the Invention

Apparatuses and methods consistent with the present invention relate to waste toner amount detecting apparatus and method which can detect whether a waste toner bottle is full of a waste toner using a change in a current of a motor which drives an auger, and an image forming apparatus using the same.

2. Description of the Related Art

In general, an image forming apparatus of an electro-photographic type using a dry toner forms a latent image on a photosensitive body by electrification and light exposure. The apparatus supplies the toner on the photosensitive body by a developing unit to form a toner image on the photosensitive body, and transfers and fuses the toner image on a printing medium. In such an image forming process, some of the supplied toner remains on the photosensitive body and a transfer unit. The remaining toner is removed by a cleaning unit. The removed toner is reused or contained in a waste toner bottle (WTB). In particular, in a color image forming apparatus, since the removed color toners are mixed each other, a waste toner bottle is necessary for containing the waste toner. However, the waste toner may overflow the waste toner bottle, which contaminates the environment within the apparatus and causes physical damage to a waste toner collecting apparatus. In order to prevent this problem, a waste toner amount detecting apparatus is required for detecting whether the waste toner bottle is full of the waste toner.

There has been a conventional waste toner amount detecting apparatus including a light sensor which has a light emitting unit and a light receiving unit and transmits light at predetermined height in the waste toner bottle to detect whether a waste toner bottle is full of a waste toner. The conventional waste toner amount detecting apparatus detects whether the waste toner bottle is full of the waste toner according to whether the light receiving unit receives light emitted from the light emitting unit.

However, the conventional waste toner amount detecting apparatus should be provided with a sensor to detect the state of the waste toner bottle. Thus, its manufacturing cost becomes high and an assembling process thereof becomes complicated. Furthermore, a light window on a light path in the waste toner bottle may be contaminated by a scattered toner. Thus, the sensor may sense that the waste toner bottle is full of the waste toner even though the waste toner bottle is not full of the waste toner.

SUMMARY OF THE INVENTION

Accordingly, it is an aspect of the present invention to provide waste toner amount detecting apparatus and method which can detect whether a waste toner bottle is full of a waste toner using a change in a current of a motor which drives an auger, and an image forming apparatus employing the same.

The foregoing and/or other aspects of the present invention can be achieved by providing an image forming apparatus including a waste toner amount detecting apparatus which detects the amount of a waste toner contained in a waste toner bottle, including: a printing medium supply unit to supply a printing medium; an image forming unit to form a toner image onto the printing medium supplied from the printing medium supply unit; a waste toner collecting unit which comprises a waste toner bottle to contain a waste toner collected from the image forming unit, an auger to level the waste toner contained in the waste toner bottle, and a motor which rotates the auger; and a waste toner amount detecting apparatus including: a motor current detector to detect a drive current of a motor which rotates an auger for leveling the waste toner contained in the waste toner bottle; and a controller which includes a determining unit to determine whether the waste toner bottle is full of the waste toner, using a difference between a first current value corresponding to a minimum drive current of the motor and a second current value corresponding to a current drive current of the motor.

According to an aspect of the invention, the controller may include a storage unit to store the first current value.

According to an aspect of the invention, the controller may update the first current value stored in the storage unit into the second current value if it is determined that the second current value is smaller than the first current value.

According to an aspect of the invention, the controller may include a notifying unit to notify, if the determining unit determines that the waste toner bottle is full of the waste toner, a user of the full state of the waste toner bottle.

According to an aspect of the invention, the motor current detector may include: a resistance element which is serially connected to the motor and in which voltage proportional to the drive current of the motor is applied to opposite ends thereof; an amplifier to amplify voltage applied to the opposite ends of the resistance element; and an A/D converter to convert the amplified voltage into a digital value and output a current value proportional to the drive current of the motor.

According to an aspect of the invention, the motor current detector may include at least one low-pass filter which is disposed between the resistance element and an input end of the amplifier and/or between an output end of the amplifier and an input end of the A/D converter, and removes noises in the voltage applied to the opposite ends of the resistance element.

Another aspect of the present invention may be achieved by providing a waste toner amount detecting method in an image forming apparatus which detects the amount of a waste toner contained in a waste toner bottle, including: setting up a first current value corresponding to a minimum drive current of a motor which rotates an auger for leveling the waste toner contained in the waste toner bottle; detecting a second current value corresponding to a current drive current of the motor; and determining whether the waste toner bottle is full of the waste toner using a difference between the first current value and the second current value.

According to an aspect of the invention, the setting up of the first current value may include setting up, as the first current value, a current value corresponding to a drive current of the motor which is initially detected when the waste toner bottle with no waste toner is installed in the image forming apparatus.

According to an aspect of the invention, the method may include updating the first current value into the second current value if it is determined that the second current value is smaller than the first current value.

According to an aspect of the invention, the determining may include, if it is determined that the difference between the first current value and the second current value is bigger than a predetermined reference value, comprising determining whether the waste toner bottle is full of the waste toner by repeating the setting up the first current value, the detecting the second current value and the determining.

According to an aspect of the invention, the method may include notifying, if it is determined that the waste toner is full of the waste toner, a user of the full state of the waste toner bottle.

According to an aspect of the invention, the detecting the first current value and the second current value may include: amplifying voltage proportional to the drive current of the motor which is applied to opposite ends of the resistance element which is serially connected to the motor; and converting the amplified voltage into a digital value.

According to an aspect of the invention, the method may include removing noises in the voltage which is applied to the opposite ends of the resistance element.

Still another aspect of the present invention may be achieved by providing a waste toner amount detecting apparatus in an image forming apparatus which detects the amount of a waste toner contained in a waste toner bottle, comprising: a motor current detector to detect a drive current of a motor which rotates an auger for leveling the waste toner contained in the waste toner bottle; and a controller which sets up a first current value corresponding to a minimum drive current and determines whether the waster toner bottle is full of the waste toner, using a difference between the first current value and a second current value corresponding to a drive current of the motor detected after the first current value is set up.

According to an aspect of the invention, the motor current detector may include: a resistance element which is serially connected to the motor and in which voltage proportional to a drive current of the motor is applied to opposite ends thereof; an amplifier to amplify the voltage applied to the opposite ends of the resistance element; and an A/D converter to convert the amplified voltage into a digital value and output a current value which is proportional to the drive current of the motor.

According to an aspect of the invention, the motor current detector may include at least one low-pass filter which is disposed between the resistance element and an input end of the amplifier and/or between an output end of the amplifier and an input end of the A/D converter, and removes noises in the voltage applied to the opposite ends of the resistance element.

Yet another aspect of the present invention may be achieved by providing a waste toner amount detecting method in an image forming apparatus which detects the amount of a waste toner contained in a waste toner bottle, comprising: detecting a current value of a drive current used by a motor to rotate an auger for leveling the waste toner contained in the waste toner bottle; and determining whether an amount of waste toner in the waste toner bottle has reached a predetermined amount using a difference between the detected current value and a stored value stored in a memory, the stored value corresponding to a minimum drive current of the motor needed to drive the auger.

Additional aspects and/or advantages of the invention will be set forth in part in the description which follows and, in part, will be obvious from the description, or may be learned by practice of the present invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
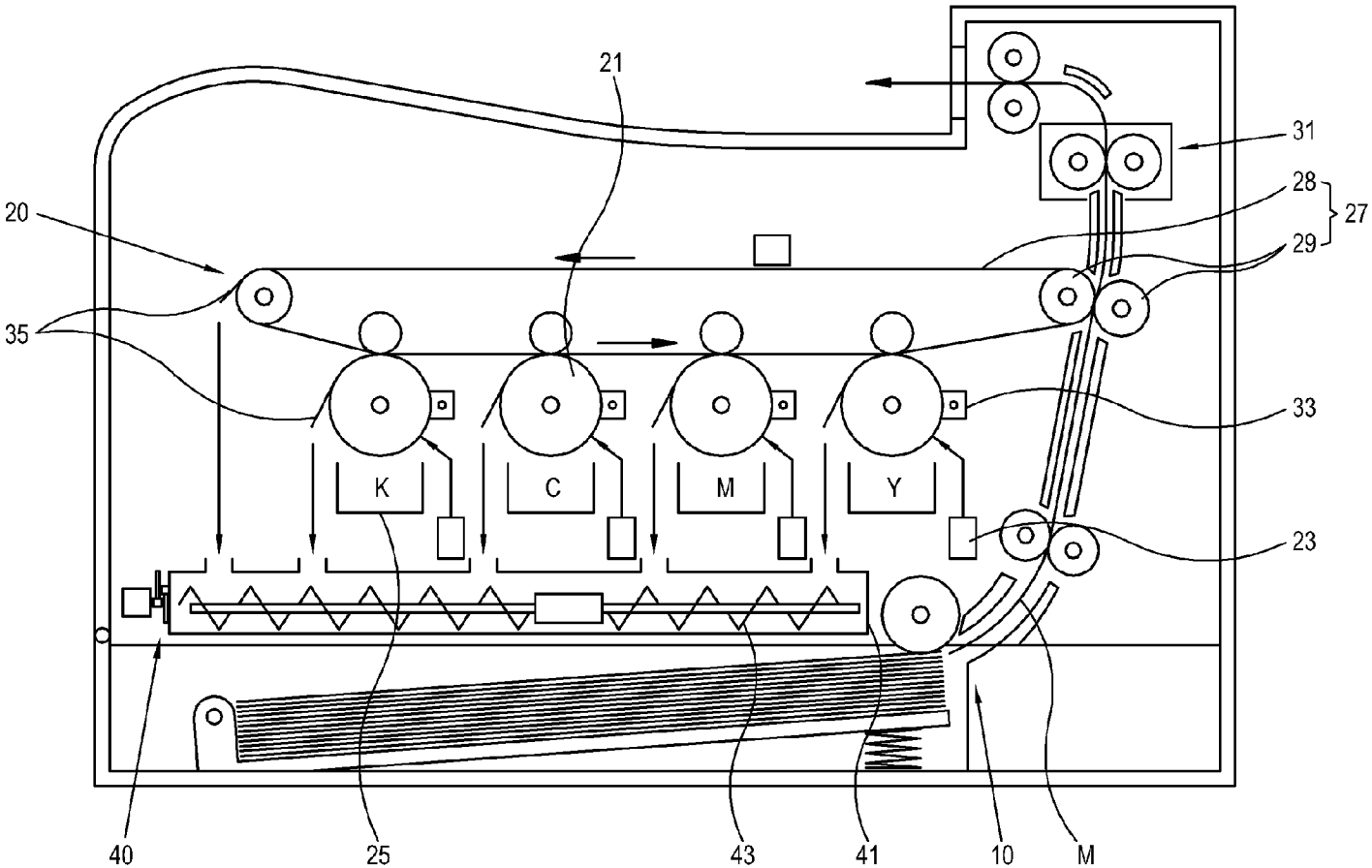
FIG. 1 is a schematic sectional view illustrating an image forming apparatus according to an exemplary embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2A:
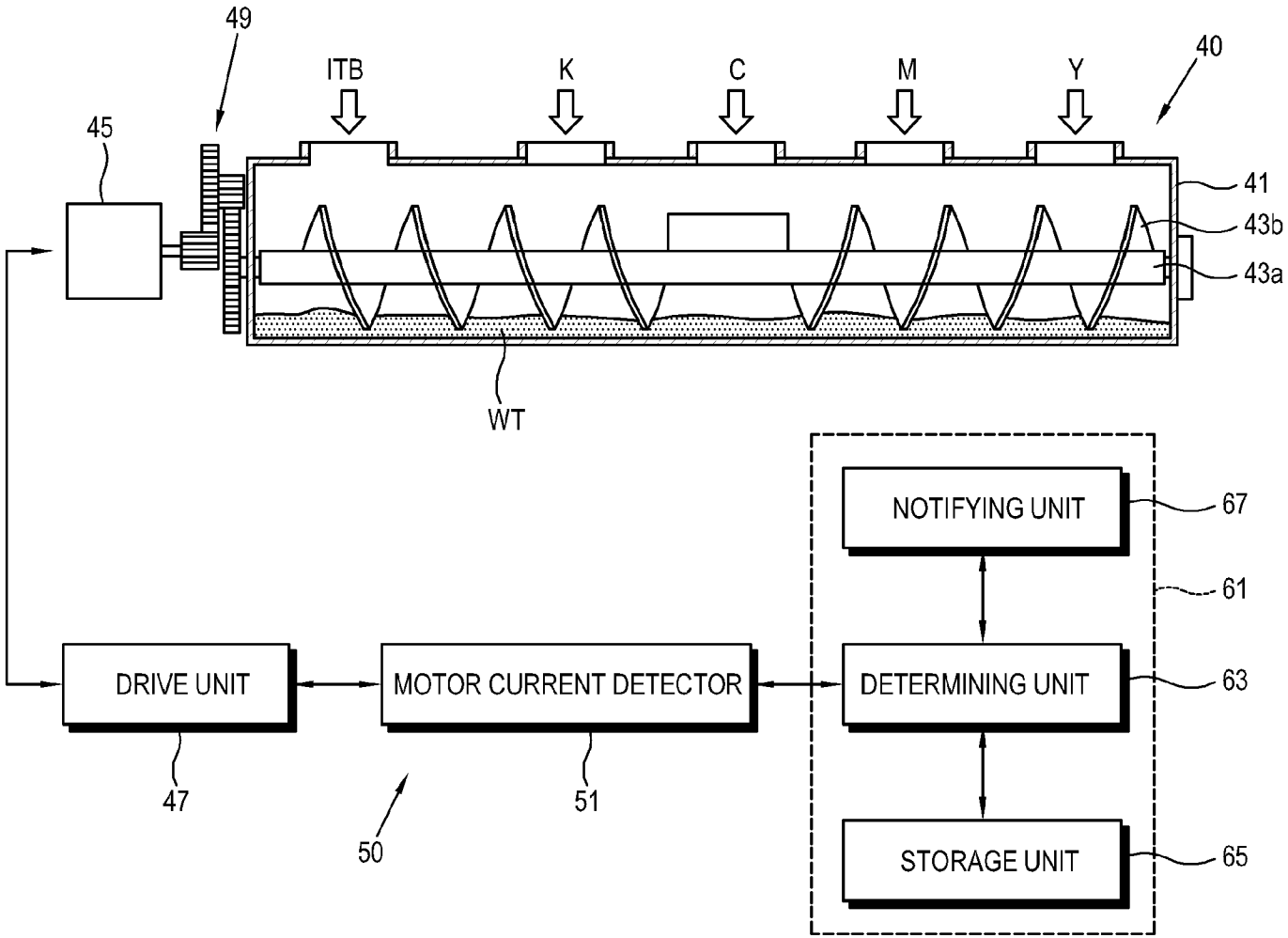
FIGS. 2A and 2B are schematic sectional views illustrating a waste toner collecting unit and a waste toner amount detecting apparatus in an image forming apparatus according to an exemplary embodiment of the present invention.
Figure 2B:
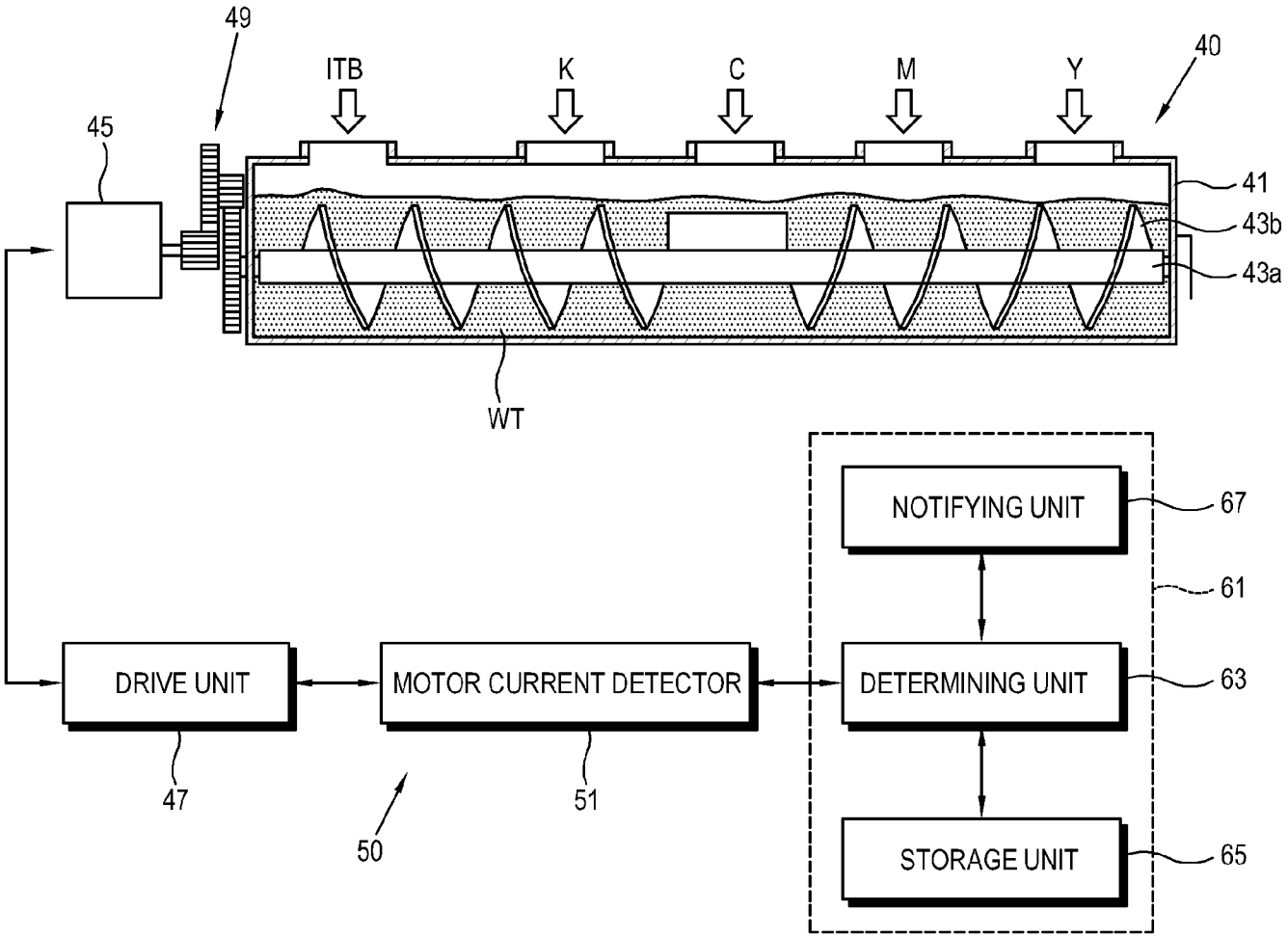

FIG. 1 schematically illustrates an image forming apparatus according to an exemplary embodiment of the present invention. While not restricted thereto, the shown example is a tandem electro-photographic color image forming apparatus. FIG. 2A and FIG. 2B are schematic sectional views illustrating a waste toner collecting unit and a waste toner amount detecting apparatus in an image forming apparatus according to an exemplary embodiment of the present invention. More specifically, FIG. 2A illustrates the state that a small amount of a waste toner is contained in a waste toner bottle; and FIG. 2B illustrates the state that the waste toner bottle is full of a waste toner.

Referring to FIG. 1, the image forming apparatus includes a printing medium supply unit 10 which supplies a printing medium M, an image forming unit 20, a waste toner collecting unit 40 and a waste toner amount detecting apparatus 50. While not shown, it is understood that additional items, such as a scanner, can be included where the image forming apparatus further includes scanning, copying and/or faxing capabilities.

The image forming unit 20 forms a color image onto the supplied printing medium M. The image forming unit 20 includes a photosensitive body 21, a light exposure unit 23, a developing unit 25, a transfer unit 27, and a fusing unit 31. The light exposure unit 23 scans light onto the photosensitive body 21 to form a latent image on the photosensitive body 21. The developing unit 25 provides a toner to the latent image formed on the photosensitive body 21 to form a toner image on the photosensitive body 21. The transfer unit 27 transfers the toner image developed on the photosensitive body 21 to the printing medium M. The fusing unit 31 fuses the image transferred to the printing medium M by applying heat and pressure.

The developing unit 25 is disposed opposite to the photosensitive body 21 and provides the toner onto an area in which the latent image is formed. While not required in all aspects, the shown image forming apparatus includes the light exposure unit 23, the developing unit 25 and the photosensitive body 21 per each color to form a full color image. FIG. 1 exemplifies four light exposure units 23, four developing units 25 and four photosensitive bodies 21 in order to realize yellow Y, magenta M, cyan C and black K, respectively. However, it is understood that other numbers of colors and other colors can be used, such as where the printer is a monocolor printer or where additional colors are used instead of or in addition to the shown yellow Y, magenta M, cyan C and black K colors.

The transfer unit 27 transfers the toner image formed on the photosensitive body 21 to the printing medium M. To this end, the transfer unit 27 includes an intermediate transfer belt (ITB) 28 and a transfer roller 29. The ITB 28 is onto which the toner image on the photosensitive body 21 is transferred from the photosensitive body 21. The transfer roller 29 transfers the image on the ITB 28 onto the printing medium M which is moving along a moving path. The image transferred onto the printing medium M through the transfer unit 27 is fused through the fusing unit 31.

Further, the image forming unit 20 includes a charger 33, an eraser (not shown), and a cleaning unit 35. The charger 33 charges the photosensitive body 21 at a predetermined electric potential. The eraser (not shown) removes an electric charge remaining in the photosensitive body 21. The cleaning unit 35 removes any foreign substance including a waste toner remaining on the photosensitive body 23 and the ITB 28 after transfer of the toner image, in a corresponding position of each photosensitive body 21. FIG. 1 illustrates a cleaning blade as an example of the cleaning unit 35, but the invention is not limited thereto.

As shown in FIGS. 1 and 2A, the waste toner collecting unit 40 includes a waste toner bottle 41 an auger 43, a motor 45, and a drive unit 47. The waste toner bottle 41 contains the waste toner collected from the image forming unit 20. The auger 43 levels the waste toner contained in the waste toner bottle 41. The motor 45 rotates the auger 43. The drive unit 47 drives the motor 45 by applying a current to the motor 45.

The auger 43 includes a rotation shaft 43*a* and a spiral carriage blade 43*b*. The rotation shaft 43*a* is rotated by the motor 45. The spiral carriage blade 43*b* is formed on a circumference of the rotation shaft 43*a* and evenly distributes the waste toner contained in the waste toner bottle 41. While not required in all aspects, in the shown example, a power transmission unit 49 is disposed between the motor 45 and the rotation shaft 43*a* to reduce a rotational speed of the motor 45 and transmit power to the rotation shaft 43*a*.

The waste toner amount detecting apparatus 50 detects the amount of the waste toner (WT) contained in the waste toner bottle 41 based on a drive current of the motor 45 without any sensor. For this purpose, the waste toner amount detecting apparatus 50 includes a motor current detector 51 and a controller 61. The current detector 51 detects the drive current of the motor 45. The controller 61 which includes a determining unit 63 which determines whether the waste toner bottle 41 is full of the waste toner. While not required in all aspects, the controller 61 can be implemented using a processor and/or computer, and can further control an operation of the image forming apparatus along or in combination with other processors.

Figure 3:
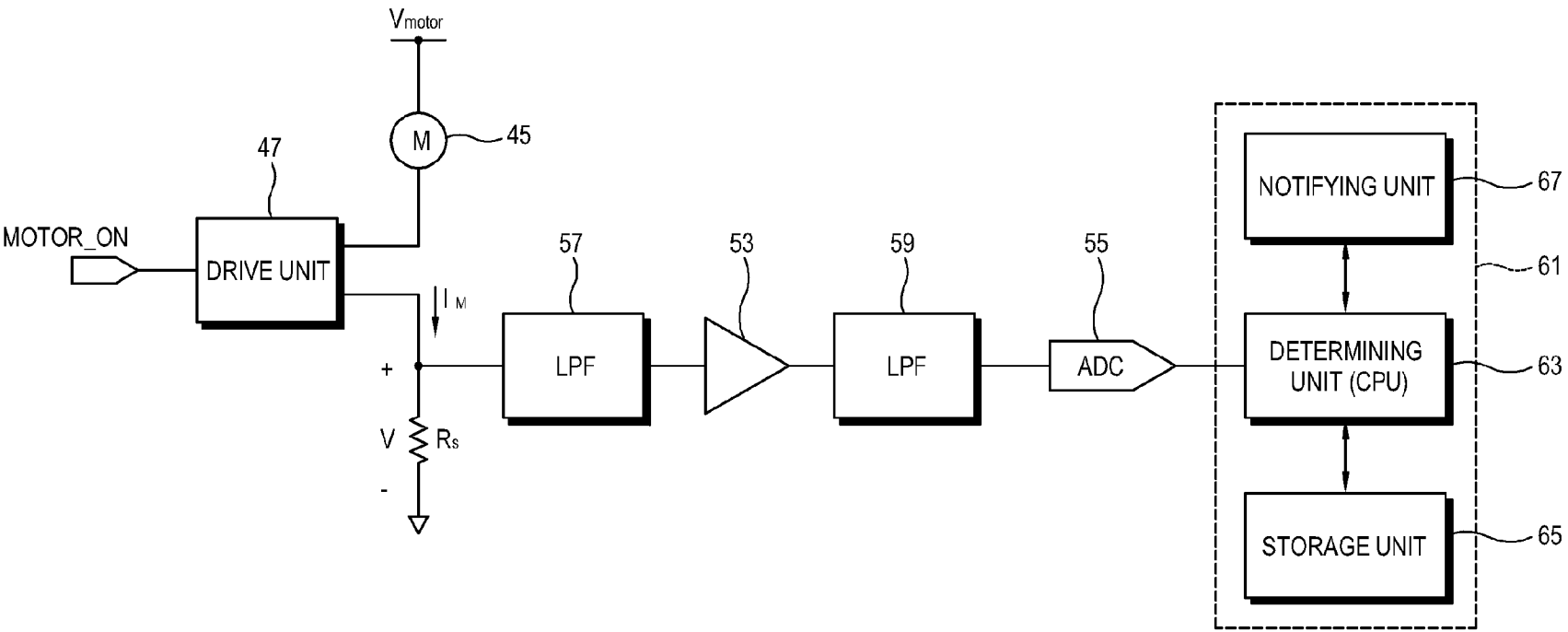
FIG. 3 is a circuit diagram illustrating a waste toner amount detecting apparatus in an image forming apparatus according to an exemplary embodiment of the present invention.

FIG. 3 is a circuit diagram illustrating the motor current detector 51 and the controller 61 according to an exemplary embodiment of the present invention. Referring to FIG. 3, the motor current detector 51 includes a resistance element $R_s$, an amplifier 53 and an ADC (analog-digital converter) 55. The resistance element $R_s$ is serially connected to the motor 45. To opposite ends of the resistance element $R_s$ is applied a voltage ($V=I_M \times R_s$) proportional to a drive current $I_M$ of the motor.

In FIG. 3, a voltage $V_{motor}$ is applied to the motor 45, and a motor driving start signal motor_ON is applied to the drive unit 47. The amplifier 53 amplifies voltage applied to the opposite ends of the resistance element $R_s$. The ADC 55 converts the amplified voltage, which has an analog value, into a digital value and outputs a current proportional to the drive current of the motor.

While not required in all aspects, in the shown embodiment, the motor current detector 51 further includes a first low-pass filter (LPF) 57 and a second low-pass filter (LPF) 59 which removes noise in the voltage applied to the opposite ends of the resistance element $R_s$. The first low-pass filter 57 is disposed between the resistance element $R_s$ and an input end of the amplifier 53; and the second low-pass filter 59 is disposed between an output end of the amplifier 53 and an input end of the ADC 55. However, it is understood that one or both of the LPFs 57, 58 need not be used in all aspects.

As described above, the motor current detector 51 can measure an increase in the drive current of the motor 45 according as the state that a small amount of the waste toner is contained in the waste toner bottle 41 as shown in FIG. 2A is changed into the state that the waste toner bottle 41 is full of the waste toner as shown in FIG. 2B. The determining unit 63 determines whether the waste toner bottle 41 is full of the waste toner, using a difference between a first current value and a second current value of the motor 45. In this respect, the first current value corresponds to a minimum drive current of the motor 45, and the second current value corresponds to a detected drive current of the motor 45. That is, the second current value is detected after the first current value is set up.

While not required in all aspects, the shown controller 61 further includes a storage unit 65 which stores the first current value. In this respect, a drive current of the motor 45 which is required for rotating the auger 43 before containing the waste toner after a new waste toner bottle 41 is installed in the image forming apparatus may be set up as the first current value. However, it is understood that the storage unit 65 can be disposed externally to the controller 61, and may comprise computer readable media, including a hard drive, flash memory, optical recording media and/or magnetic recording media.

As shown in FIG. 2A, in the case that the small amount of the waste toner is contained in the waste toner bottle 41, a current drive current of the motor 45 may be less than the first current value already stored in the storage unit 65. When it is determined that the second current value is smaller than the stored first current value, the controller 61 updates the first current value stored in the storage unit 65 to be the second current value. As such, the storage unit 65 stores the minimum current value and updates the minimum current value during use.

In a similar way, the determining unit 63 compares the updated first current value stored in the storage unit 65 with a new second current value to detect whether the waste toner bottle 41 is full of the waste toner. More specifically, the determining unit 63 compares a difference between the second current value and the stored first current value. Where the difference is greater than 0, the difference is then compared with a reference value. The reference value indicates a preset current corresponding to a full state of the waste toner bottle as measured from a preset minimum current to detect whether the waste toner bottle 41 is full of the waste toner regardless of whether the stored first current is the same as the preset minimum current.

Figure 4A:
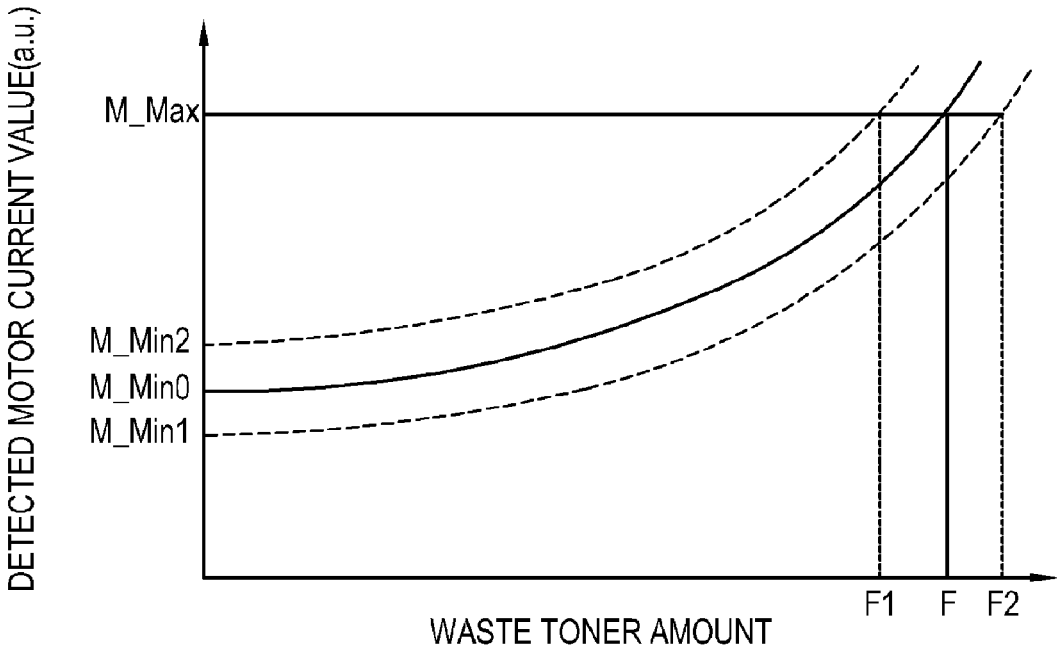
FIGS. 4A and 4B are graphs respectively illustrating waste toner amount detecting results according to a current value of a motor in a waste toner amount detecting apparatus according to a comparative example and an exemplary embodiment of the present invention.
Figure 4B:
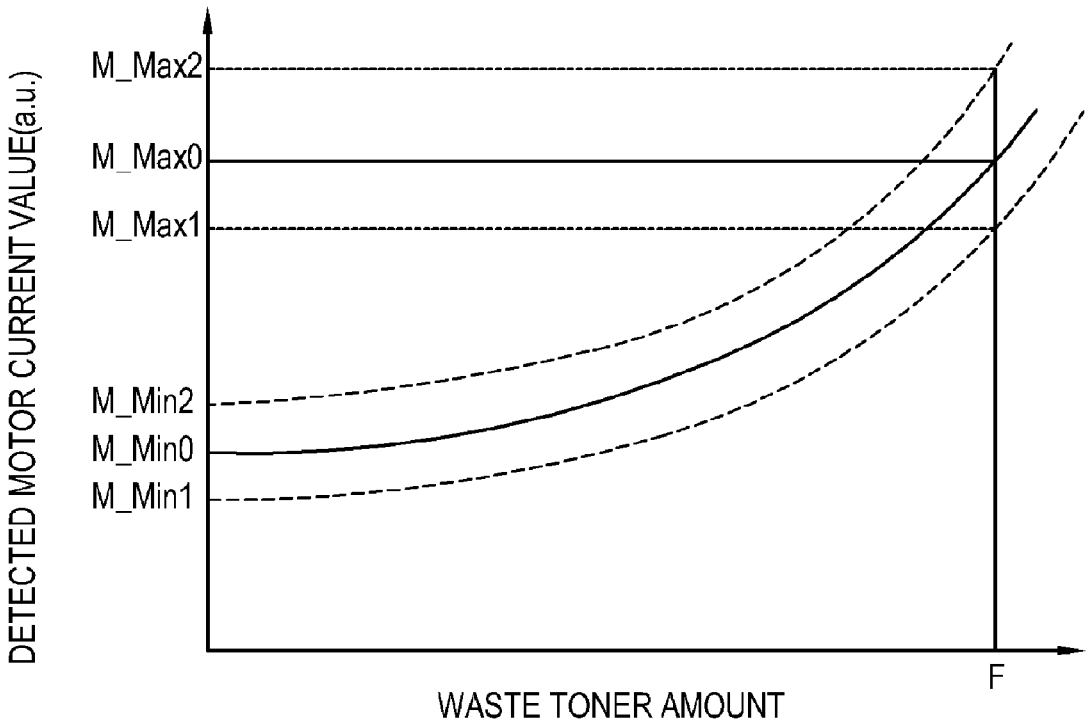

FIG. 4A and FIG. 4B are graphs respectively illustrating waste toner amount detecting results according to a current value of a motor 45 in a waste toner amount detecting apparatus according to a comparative example and an exemplary embodiment of the present invention. Referring to FIGS. 4A and 4B, the detected motor current values vary differently as the amount of the waste toner varies. Accordingly, a minimum current value indicated as the first current value may be different according to characteristics of the respective waste toner collecting apparatuses. FIGS. 4A and 4B illustrate the case that the minimum current value has three different values M_Min0, M_Min1 and M_Min2.

FIG. 4A illustrates the case that a motor current value M_Max indicating a full amount of the waste toner (F) is fixed as a specific current value. That is, the case that the full amount of the waste toner (F) is fixed based on the minimum current value M_Min0. While described as a full value (F), it is understood that the value (F) can also be any amount less than the full value of the waste toner bottle 41 depending on the need, and need not be the exact full amount in all aspects. For instance, the fully value (F) may represent a lesser amount to accommodate delays of a user in replacing the waster toner bottle 41 after being notified.

In the case of the minimum current value M_Min1 as opposed to the fixed minimum value, the amount of the waste toner is F2 when the value M_Max is detected. The full amount F2 is beyond the maximum amount F. However, the capacity of the waste toner bottle 41 remains the same, regardless of the starting minimum current value. Accordingly, the waste toner may flow over the waste toner bottle 41 since the capacity of the waste toner bottle 41 will be exceeded prior to the current value M_Max. This may cause deterioration in image quality and environmental pollution in the image forming apparatus.

In contrast, in the case of the minimum current value M_Min2, the full amount of the waste toner when the value M_Max is detected is F1, which does not reach the maximum amount F. Accordingly, although the waste toner bottle 41 is not full of the waste toner, the current value M_Max will be detected and the waste toner bottle 41 should be frequently replaced even though it is not actually full.

FIG. 4B illustrates the case that a maximum current value M_Max of the motor indicating the full amount of the waste toner is differently set up according to a minimum current value. That is, the maximum current values M_Max0, M_Max1 and M_Max2 are obtained by adding the minimum current values M_Min0, M_Min1 and M_Min2 to a reference value (REF), respectively. In the case that the minimum current value is M_Min0, M_Min1 and M_Min2, respectively, the full amount of the waste toner F is detected when motor current values corresponding to different maximum current values M_Max1, M_Min0 and M_Max2 are detected, respectively. Accordingly, it is possible to prevent the state that the waste toner flows over the waste toner bottle 41 or the state that the waste toner bottle is not full of the waste toner from being detected as the full amount of the waste toner. When the determining unit 63 determines whether the waste toner is full, the controller 61 may repeatedly detect whether the waste toner bottle 41 is full of the waste toner several times to improve accuracy of the detection. The reference value REF can be set by the manufacturer of the waste toner bottle 41 and correspond to a difference between the average maximum current value and average minimum current value. The reference value REF can be determined experimentally and/or calculated in aspects of the invention.

While not required in all aspects, the shown controller 61 further includes a notifying unit 67. The notifying unit 67 notifies, if the determining unit 63 determines that the waste toner bottle 41 is full of the waste toner, a user of the full state of the waste toner bottle. The notifying unit 67 may employ a display panel or a display lamp provided in the image forming apparatus, a display unit of a host apparatus connected to the image forming apparatus, a sound, or the like.

As described above, the waste toner amount detecting apparatus and the image forming apparatus employing the same according to the shown embodiment may detect a change in a drive current of a motor 45 as the amount of the waste toner contained in the waste toner bottle 41 is increased to detect the full state of the waste toner bottle, thereby simplifying its configuration and the manufacturing process compared with the conventional method employing a separate detecting sensor. Further, when detecting the full state of the waste toner bottle 41, a maximum current of the motor 45 is varied according to a detected minimum current of the motor 45, thereby detecting the full state of the waste toner bottle 41 when the waste toner bottle is actually full of the waste toner.

Figure 5:
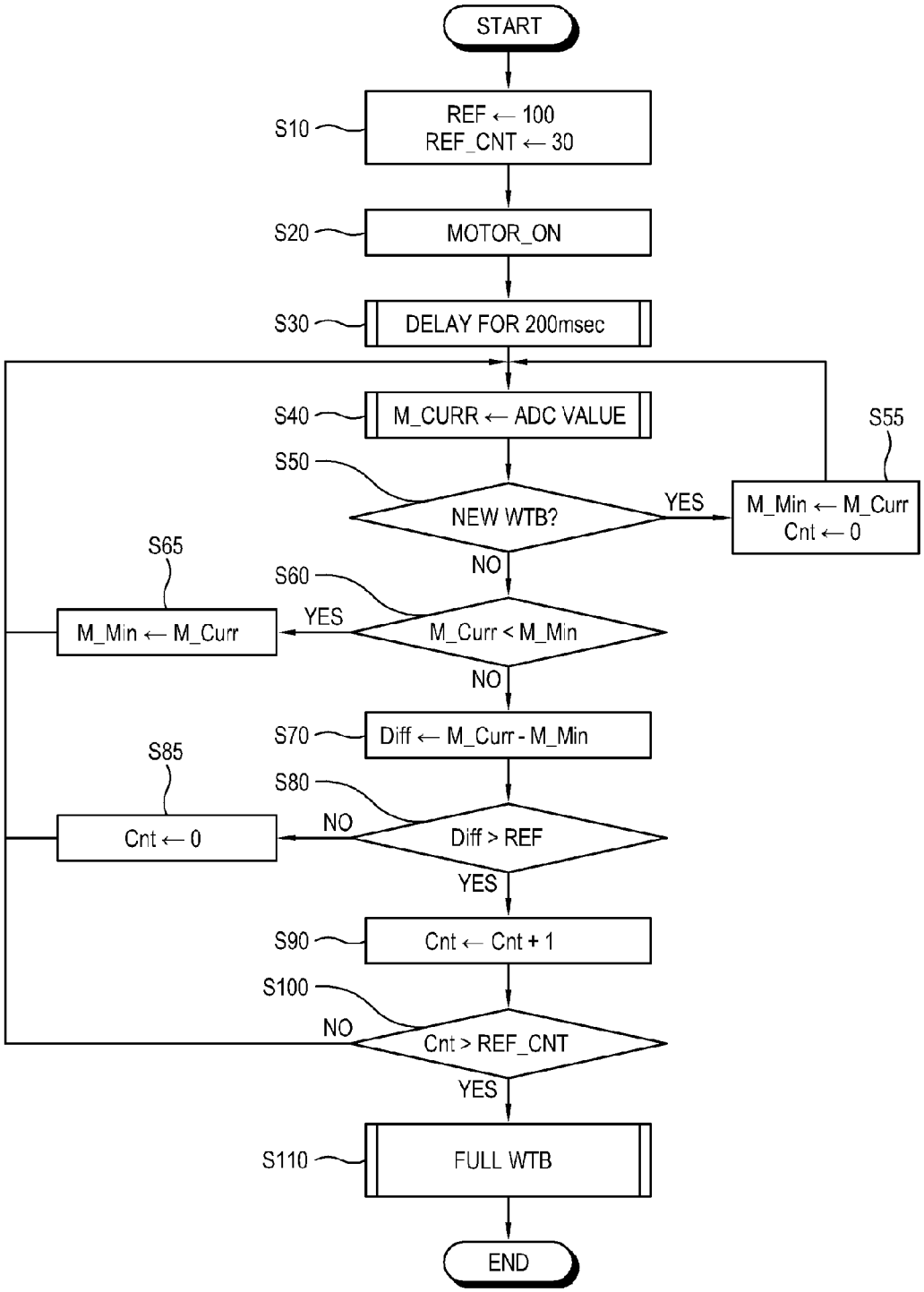
FIG. 5 is a flowchart illustrating a waste toner detecting method in an image forming apparatus according to an exemplary embodiment of the present invention.

FIG. 5 is a flowchart illustrating a waste toner amount detecting method in an image forming apparatus according to an exemplary embodiment of the present invention. Referring to FIGS. 1 to 5, the waste toner amount detecting method in the image forming apparatus includes setting up the first current value M_Min (S55 and S65); detecting the second current value M_Curr (S40); and determining whether the waste toner bottle 41 is full of the waste toner using a difference between the first current value M_Min and the second current value (M_Curr). In this respect, the first current value M_Min corresponds to a minimum drive current of the motor 45 which rotates the auger 43 for leveling the waste toner contained in the waste toner bottle 41; and the second current value M_Curr corresponds to a current drive current of the motor 45.

The first current value M_Min and the second current value M_Curr may be detected by amplifying voltage which is proportional to a drive current of the motor 45 and is applied to opposite ends of the resistance element $R_s$ which is serially connected to the motor 45 and by converting the amplified voltage into a digital value through the ADC 55. Further, when detecting the first and second current values, the method according to the present embodiment may include removing noises in the voltage applied to the opposite ends of the resistance element $R_s$.

More specifically, an initial conditional value is firstly set up (S10). For example, a reference value REF indicating a current corresponding to a full state of the waste toner bottle may be preset as 100; and a coefficient value REF_CNT indicating the number of determining the full state may be set up as 30. Here, the value 100 corresponds to a digital value converted through the ADC 55. Such set up can be at a manufacturing site of the apparatus or by an end user. Further, the reference value REF and/or REF_CNT can be stored in the storage unit 65. Then, a drive current is applied to the motor 45 (motor_ON) to operate the auger 43 (S20). In this respect, in order to remove an unstable inrush current when the motor 45 is initially driven, a predetermined time (for example, 200 msec) is delayed (S30).

As described above, after operations S10 to S30, the first current value is set up and the second current value is detected. That is, after operation S30, a current value outputted from the ADC 55 is set up as the second current value M_Curr. Then, it is determined whether the waste toner bottle 41 is a new waste toner bottle (S50). If the waste toner bottle 41 is new, the currently detected second current value M_Curr is set up as the first current value M_Min, and the value M_Min is stored in the storage unit 65. The coefficient value Cnt for repeatedly detecting the full state of the waste toner bottle is initialized into zero (Cnt←0) (S55). However, it is understood that the first current value can be a preset number when a new waste toner bottle 41 is added, such that operation S55 need not be performed using a detected current until at least the predetermined number of counts Cnt reaches a predetermined number. Further, operations S50 and S55 can be performed prior to operation S40, and the setting of the minimum drive current using a detected current need not be performed in operation S55.

If it is determined in S50 that the waste toner bottle 41 is not new, the second current value M_Curr is compared with the first current value M_Min stored in the storage 65 (S60). If it is determined that the second current value M_Curr is smaller than the first current value M_Min, the first current value M_Min stored in the storage unit 65 is updated to be the second current value M_Curr (S60), and then the procedure returns to operation S40.

If it is determined that the second current value M_Curr is equal to or bigger than the first current value M_Min in S60, a difference (Diff) between the second current value M_Curr and the first stored current value M_Min is calculated (Diff←M_Curr−M_Min) (S70). Then, the calculated difference Diff is compared with the reference value REF (S80). If the difference Diff is equal to or smaller than the reference value REF, the controller 61 determines that the waste toner bottle 41 is not in the full state and initializes the coefficient value Cnt into zero (Cnt←0) (S85). Then, the procedure returns to operation S40.

If it is determined in S80 that the difference Diff is bigger than the reference value REF (Diff>REF), the coefficient value is updated (Cnt←Cnt+1) (S90). Then, the updated coefficient value Cnt is compared with the reference coefficient value (REF_CNT) (S100). If the coefficient value Cnt is equal to or smaller than the reference coefficient value REF_CNT, operations S40 to S100 are repeated as many times as the given reference coefficient value REF_CNT (30 times in FIG. 5). If the coefficient value Cnt is bigger than the reference coefficient value REF_CNT, it is determined that the waste toner bottle 41 is in the full state (S110).

The above-described process in operation S100 is used for improving accuracy of detection, and need not be used in all aspects of the invention. In the shown embodiment, the full states of the waste toner bottle 41 may be detected based on a one-time determination result (for example, REF_CNT=0 or by not including operations S90 and S100).

Further, if it is determined that the waste toner bottle 41 is full of the waste toner in operation S110, the method according to embodiment may further include notifying (not shown) a user of the full state thereof.

As described above, according to the waste toner amount detecting method in the image forming apparatus according to aspects of the present invention, in setting up a maximum current value of the motor corresponding to the full state of the waste toner bottle, the full state of the waste toner bottle can be exactly detected using a difference between the reference value REF and the difference value Diff, without any detection sensor.

As described above, the waste toner amount detecting apparatus and method according to aspects of the present invention, and the image forming apparatus employing the same can detect whether a waste toner bottle is full of a waste toner without any detection sensor, thereby reducing its manufacturing cost, simplifying manufacturing process and preventing an error which may be caused by the sensor.

Further, when detecting whether the waste toner bottle is full of the waste toner using a change in a drive current of a motor according to an aspect of the invention, the full state of the waste toner bottle is determined using a minimum current value and a current drive current value, thereby reducing an error due to tolerances or assembly deviations of the image forming apparatus and the waste toner collecting unit.

Further according to aspects of the invention, the full state of the waste toner bottle is detected several times, thereby improving accuracy of the detection.

While not required in all aspects, all or portions of the method of the present invention can be implemented using software and/or firmware encoded on one or more computer readable media and executed by one or more computers and/or processors.

Although a few embodiments of the present invention have been shown and described, it would be appreciated by those skilled in the art that changes may be made in this embodiment without departing from the principles and spirit of the invention, the scope of which is defined in the appended claims and their equivalents.

What is claimed is:

1. An image forming apparatus, comprising:

a printing medium supply unit to supply a printing medium;

an image forming unit to form a toner image onto the printing medium supplied from the printing medium supply unit;

a waste toner bottle to contain a waste toner collected from the image forming unit, an auger to level the waste toner contained in the waste toner bottle, and a motor which rotates the auger; and a waste toner amount detecting apparatus which detects an amount of the waste toner contained in the waste toner bottle, comprising:

a motor current detector to detect a drive current of the motor which rotates the auger for leveling the waste toner contained in the waste toner bottle; and a controller which comprises a determining unit to determine whether the waste toner bottle is full of the waste toner using a difference between a first current value corresponding to a minimum drive current of the motor and a second current value corresponding to the detected drive current of the motor.

2. The apparatus according to claim 1, wherein the controller further comprises a storage unit to store the first current value.

3. The apparatus according to claim 2, wherein the controller updates the first current value stored in the storage unit to be the second current value if it is determined that the second current value is smaller than the first current value.

4. The apparatus according to claim 1, wherein the controller further comprises a notifying unit to notify a user of a full state of the waste toner bottle when the determining unit determines that the waste toner bottle is full of the waste toner.

5. The apparatus according to claim 1, wherein the motor current detector comprises:

a resistance element serially connected to the motor and having opposite ends to which a voltage proportional to the drive current of the motor is applied;

an amplifier to amplify the voltage applied to the opposite ends of the resistance element; and an analog to digital (A/D) converter to convert the amplified voltage into a digital value and output a current value proportional to the drive current of the motor.

6. The apparatus according to claim 5, wherein the motor current detector further comprises at least one low-pass filter which is disposed between the resistance element and an input end of the amplifier and/or between an output end of the amplifier and an input end of the A/D converter, and removes noise in the voltage applied to the opposite ends of the resistance element.

7. A waste toner amount detecting method in an image forming apparatus which detects an amount of a waste toner contained in a waste toner bottle, comprising:

setting up a first current value corresponding to a minimum drive current of a motor which rotates an auger for leveling the waste toner contained in the waste toner bottle;

detecting a second current value corresponding to a current drive current of the motor; and determining whether the waste toner bottle is full of the waste toner using a difference between the set up first current value and the detected second current value.

8. The method according to claim 7, wherein the setting up the first current value comprises setting up, as the first current value, a current value corresponding to a drive current of the motor which is initially detected when an empty waste toner bottle is installed in the image forming apparatus.

9. The method according to claim 8, further comprising updating the first current value to be the detected second current value when it is determined that the second current value is smaller than the set up first current value.

10. The method according to claim 9, wherein the determining comprises, when it is determined that the difference between the set up first current value and the detected second current value is greater than a predetermined reference value, again determining whether the waste toner bottle is full of the waste toner by repeating the setting up the first current value, the detecting the second current value and the determining.

11. The method according to claim 10, further comprising notifying a user of a full state of the waste toner bottle when it is determined that the waste toner is full of the waste toner.

12. The method according to claim 7, wherein the detecting the second current value comprises:

amplifying a voltage proportional to the drive current of the motor which is applied to opposite ends of a resistance element which is serially connected to the motor; and converting the amplified voltage into a digital value.

13. The method according to claim 12, further comprising removing noise in the voltage which is applied to the opposite ends of the resistance element.

14. A waste toner amount detecting apparatus in an image forming apparatus which detects an amount of a waste toner contained in a waste toner bottle, comprising:

a motor current detector to detect a drive current of a motor which rotates an auger for leveling the waste toner contained in the waste toner bottle; and a controller which sets up a first current value corresponding to a minimum drive current and determines whether the waster toner bottle is full of the waste toner using a difference between the set up first current value and a second current value corresponding to the detected drive current of the motor detected after the first current value is set up.

15. The apparatus according to claim 14, wherein the motor current detector comprises:

a resistance element which is serially connected to the motor and having opposite ends to which is applied a voltage proportional to a drive current of the motor;

an amplifier to amplify the voltage applied to the opposite ends of the resistance element; and an analog to digital (A/D) converter to convert the amplified voltage into a digital value and output a current value which is proportional to the drive current of the motor.

16. The apparatus according to claim 15, wherein the motor current detector further comprises at least one low-pass filter which is disposed between the resistance element and an input end of the amplifier and/or between an output end of the amplifier and an input end of the A/D converter, and removes noise in the voltage applied to the opposite ends of the resistance element.

17. A waste toner amount detecting method in an image forming apparatus which detects an amount of a waste toner contained in a waste toner bottle, comprising:

detecting a current value of a drive current used by a motor to rotate an auger for leveling the waste toner contained in the waste toner bottle; and determining whether an amount of waste toner in the waste toner bottle has reached a predetermined amount using a difference between the detected current value and a stored value stored in a memory, the stored value corresponding to a minimum drive current of the motor needed to drive the auger.

18. The method according to claim 17, further comprising storing as the value in the memory, an initially detected current value corresponding to a drive current of the motor which is initially detected when an empty waste toner bottle is installed in the image forming apparatus.

19. The method according to claim 17, further comprising updating the stored value stored in the memory to be the detected current value when it is determined that the detected current value is less than the stored value stored in the memory.

20. The method according to claim 17, further comprising, when it is determined that the difference between the stored value and the detected current value is greater than a predetermined reference value, again confirming that the waste toner bottle has reached the predetermined amount of the waste toner by repeating the detecting the current value and the determining.

* * * * *